United States Patent [19]

Kondo et al.

[11] 4,430,976

[45] Feb. 14, 1984

[54] METHOD FOR CONTROLLING AIR/FUEL RATIO IN INTERNAL COMBUSTION ENGINES

[75] Inventors: Toshio Kondo; Shigenori Isomura; Akio Kobayashi; Katsuhiko Kodama, all of Kariya, Japan

[73] Assignee: Nippondenso Co., Ltd., Kariya, Japan

[21] Appl. No.: 312,076

[22] Filed: Oct. 16, 1981

[30] Foreign Application Priority Data

Oct. 20, 1980 [JP] Japan ..... 55-147352

[51] Int. Cl.[3] ..... F02B 3/00

[52] U.S. Cl. ..... 123/440; 123/480; 123/489; 364/431.06

[58] Field of Search ..... 123/352, 440, 480, 489, 123/445, 486, 431, 478; 364/431.06

[56] References Cited

U.S. PATENT DOCUMENTS

| | | | |
|---|---|---|---|
| 4,306,523 | 12/1981 | Takeda | 123/489 |
| 4,319,451 | 3/1982 | Tajima et al. | 123/440 |
| 4,321,903 | 3/1982 | Kondo et al. | 123/489 |
| 4,345,561 | 8/1982 | Kondo et al. | 123/440 |
| 4,348,727 | 9/1982 | Kobayashi et al. | 123/440 |
| 4,348,728 | 9/1982 | Sagisaka et al. | 123/440 |
| 4,355,616 | 10/1982 | Tamura et al. | 123/440 |
| 4,365,299 | 12/1982 | Kondo et al. | 123/489 |

*Primary Examiner*—Raymond A. Nelli

*Attorney, Agent, or Firm*—Cushman, Darby & Cushman

[57] ABSTRACT

In a feedback control system for air/fuel ratio control of an internal combustion engine, an integration correcting amount is derived from the output signal of a gas sensor indicative of the concentration of an exhaust gas component, and an engine condition correcting amount is selected from a memory in which a plurality of engine condition correcting amounts are prestored in the form of a map. The engine condition correcting amount is renewed in accordance with the variation in the value of the integration correcting amount only within a given period of time or within an inteval corresponding to a given number of rotations of the engine crankshaft from an instant of detection of the variation of the gas sensor output level. Thus, the engine condition correcting amount is renewed only when the output signal level of the gas sensor is reliable. In the case that the gas sensor output level does not change for a relatively long period of time, the integration correction amount is set to a standard value, while the engine condition correcting amount is not changed, using prestored data.

8 Claims, 7 Drawing Figures

| Q \ N | 1 | 2 | 3 | | | n-2 | n-1 | n | n+1 | n+2 | ---- | ---- | |
|---|---|---|---|---|---|---|---|---|---|---|---|---|---|
| 1 | $K^1_1$ | $K^1_2$ | $K^1_3$ | | | | | | | | | | |
| 2 | $K^2_1$ | $K^2_2$ | $K^2_3$ | | | | | | | | | | |
| 3 | $K^3_1$ | $K^3_2$ | $K^3_3$ | | | | | | | | | | |
| ⋮ | | | | | | | | | | | | | |
| m-1 | | | | | | $K^{m-1}_{n-2}$ | $K^{m-1}_{n-1}$ | $K^{m}_{n}$ | $K^{m-1}_{n+1}$ | $K^{m-1}_{n+2}$ | | | |
| m | | | | | | $K^{m}_{n-2}$ | $K^{m}_{n-1}$ | $K^{m}_{n}$ | $K^{m}_{n+1}$ | $K^{m}_{n+2}$ | | | |
| m+1 | | | | | | $K^{m+1}_{n-2}$ | $K^{m+1}_{n-1}$ | $K^{m+1}_{n}$ | $K^{m+1}_{n+1}$ | $K^{m+1}_{n+2}$ | | | |
| ⋮ | | | | | | | | | | | | | |
| ⋮ | | | | | | | | | | | | | |

METHOD FOR CONTROLLING AIR/FUEL RATIO IN INTERNAL COMBUSTION ENGINES

BACKGROUND OF THE INVENTION

This invention relates generally to a method for controlling air/fuel ratio of a mixture supplied to an internal combustion engine by means of a feedback control system. More particularly, the present invention relates to such a method for controlling air/fuel ratio on the basis of detected concentration of an exhaust gas component.

In a typical conventional feedback air/fuel ratio control system for an internal combustion engine of an automotive vehicle or the like, the air fuel ratio of the mixture is determined by correcting a basic or standard quantity or flow rate of fuel to be supplied to the engine cylinders in accordance with various information relating to engine parameters and the concentrations of a given gas in the exhaust gasses. In the conventional feedback air/fuel ratio control systems, the quantity of fuel supplied to the engine per unit time is controlled on the basis of the integration of the output signal of the air/fuel ratio sensor. Therefore, in the transient conditions of the engine operation, if the air/fuel ratio varies at a higher speed than the correcting speed based on the integration control, the correction cannot catch up with the variation of the actual air/fuel ratio. Furthermore, in the case that the air/fuel ratio sensor is inactive, an accurate control of air/fuel ratio cannot be performed, for instance, feedback control cannot be performed, to cause the deterioration of the exhaust gasses.

SUMMARY OF THE INVENTION

The present invention has been developed in order to remove the above-mentioned disadvantages and drawbacks inherent to the conventional closed loop air/fuel ratio control system for an internal combustion engine.

It is, therefore, a primary object of the present invention to provide a method for accurately and quickly controlling the air/fuel ratio of an air/fuel mixture supplied to an internal combustion engine even in the transient conditions of engine operation.

Another object of the present invention is to provide a method for accurately and quickly controlling the air/fuel ratio of an air/fuel mixture supplied to an internal combustion engine even in the case that the air/fuel ratio sensor is inactive.

In accordance with the present invention, a variable which determines the fuel flow or air/fuel ratio is first obtained by selecting an appropriate value suitable for engine operating conditions. This variable may correspond to a time length for which fuel is supplied to an internal combustion engine in the case of an engine equipped with a fuel injection system. The variable is not directly used but is corrected by two or more correction factors. Namely, the variable is corrected by an integration correcting amount which is derived by integrating a gas sensor output signal in the same manner as in prior art. Furthermore, another correction factor, i.e. an engine condition correction amount, is selected by using engine parameters, such as engine speed and intake airflow, and the selected engine condition correction amount is then modified or renewed by using the integration correction amount. The renewed engine condition correction factor is also used to correct the above-mentioned variable. As will be described later in detail, the renewal of the engine condition correcting amount is effected at particular timings so that undesirable change in the value thereof is avoided.

BRIEF DESCRIPTION OF THE DRAWINGS

These and other objects and features of the present invention will become more readily apparent from the following detailed description of the preferred embodiment taken in conjunction with the accompanying drawings in which.

DETAILED DESCRIPTION OF THE PREFERRED EMBODIMENT

Figure 1:
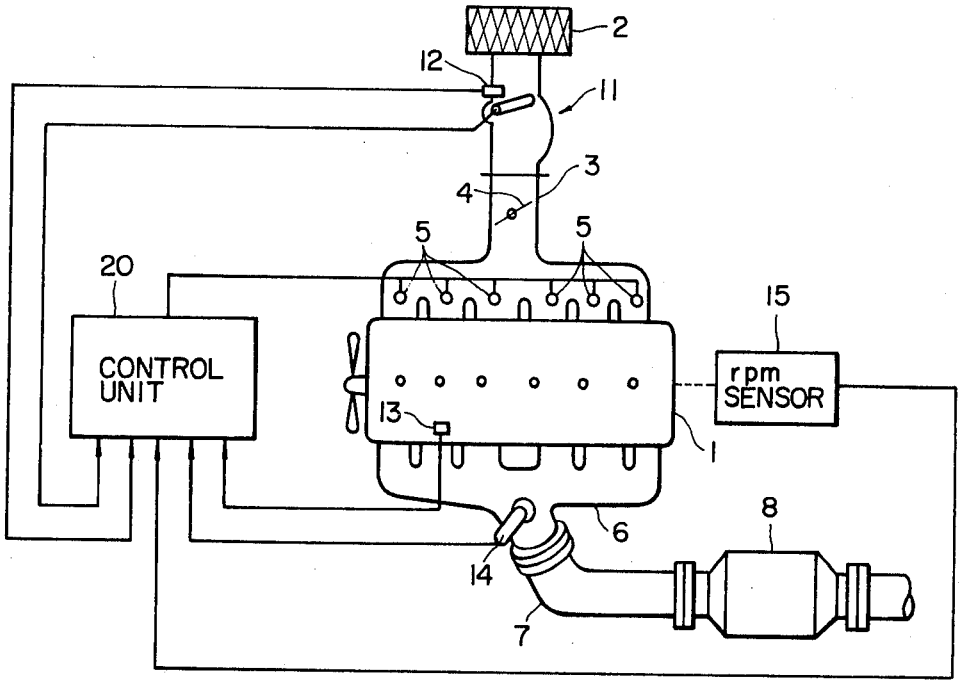
FIG. 1 is a schematic view of an air/fuel ratio control system of an internal combustion engine to which the of the present invention is applied.

FIG. 1 illustrates a feedback air/fuel ratio control system of an internal combustion engine mounted on an automotive vehicle. An internal combustion engine 1, which is mounted on an automotive vehicle (not shown), is of well known 4-cycle spark-ignition type. The engine 1 is supplied with air via an air cleaner 2, an intake manifold 3 and a throttle valve 4 provided in the intake manifold 3. The engine 1 is also supplied with fuel via a plurality of fuel injection valves 5 corresponding to each cylinder from a fuel supply system (not shown). The exhaust gasses produced as the result of combustion are discharged into atmosphere through an exhaust manifold 6, and an exhaust pipe 7 and a three-way catalytic converter 8.

The intake manifold 3 is equipped with an airflow meter 11 constructed of a movable flap and a potentiometer, the movable contact of which is operatively connected to the flap. The intake manifold 3 is equipped with a thermistor type temperature sensor 12 for producing an output analog signal indicative of the temperature of the intake air. A second thermistor type temperature sensor 13 is shown to be coupled to the engine 1 for producing an output analog signal indicative of the coolant temperature.

An oxygen sensor 14, which functions as an air/fuel ratio sensor, is disposed in the exhaust manifold 6 for producing an output analog signal indicative of the concentration of the oxygen contained in the exhaust gasses. As is well known, the oxygen concentration represents the air/fuel ratio of the mixture supplied to the engine 1, and for instance, the output voltage of the oxygen sensor 14 is approximately 1 volt when the detected air/fuel ratio is smaller, i.e. richer, than the stoichiometric air/fuel ratio; and is approximately 0.1 volt when the detected air/fuel ratio is higher, i.e. leaner, than the same. Accordingly, the gas sensor output can be treated as a digital signal.

A rotational speed sensor 15 is employed for detecting the engine rpm. Namely, the rotational speed of the engine crankshaft (not shown) is indicated by the number of pulses produced per unit time. Such a pulse train signal, i.e. a rotation synchronized signal, may be readily derived from the primary winding of the ignition coil of the ignition system (not shown).

The output signals of the above-mentioned circuits, namely the airflow meter 11, the intake air temperature sensor 12, the coolant temperature sensor 13, the oxygen sensor 14, and the rotational speed (rpm) sensor 15, are respectively applied to a control unit 20 which may be constructed of a microcomputer system.

Figure 2:
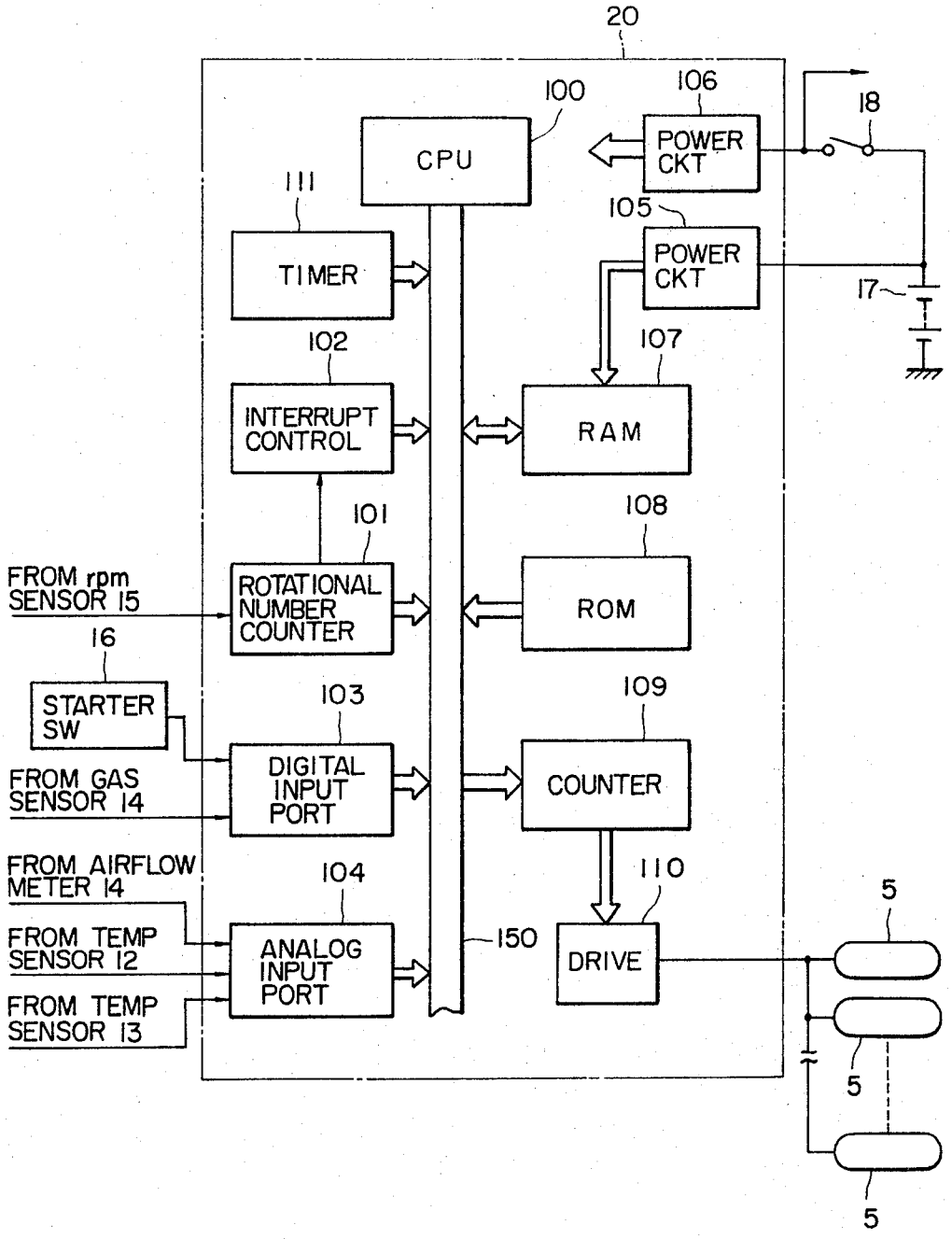
FIG. 2 is a schematic block diagram of the control unit shown in FIG. 1.

FIG. 2 illustrates a detailed block diagram of the control unit 20 shown in FIG. 1. The control unit 20 comprises a microprocessor, i.e. a central processing unit CPU, for calculating the quantity of fuel to be supplied to the engine 1 in accordance with various information applied thereto. A counter 101 for counting the number of rotations of the engine crankshaft is responsive to the output signal of the above-mentioned rotational speed sensor 15. The counter 101 has first and second outputs respectively connected to a common bus 150 and to an input of an interrupt control unit 102 the output of which is connected to the common bus 150. With this arrangement the counter 101 is capable of supplying the interrupt control unit 102 with an interrupt instruction. In receipt of such an instruction the interrupt control unit 102 produces an interrupt signal which is fed to the CPU 100 via the common bus 150.

A digital input port 103 is provided for receiving digital signals from the air/fuel ratio sensor 14 and from a starter switch 16 with which the engine starter (not shown) is turned on and off. These digital signals are applied via the common bus 150 to the CPU 100. An analog input port 104, which is constructed of an analog multiplexer and an A/D converter, is used to convert analog signals from the airflow meter 11, the intake air temperature sensor 12, and from the coolant temperature sensor 13 in a sequence, and then to deliver the converted signals via the common bus 150 to the CPU 100.

A first power supply circuit 105 receives electric power from a power source 17, such as a battery mounted on the motor vehicle. This first power supply circuit 105 supplies a RAM 107, which will be described hereinlater, with electrical power, and is directly connected to the power source 17 rather than through a switch. A second power supply circuit 106 is, however, connected to the power source 17 via a switch 18, which may an ignition key or a switch controlled by the ignition key. The second power supply circuit 106 supplies all of the circuits included in the control unit 20 except for the above-mentioned RAM 107.

The RAM 107 is used to temporarily store various data during the operations of the CPU 100. Since the RAM 107 is continuously fed with electrical power from the power source 17 through the first power supply circuit 105, the data stored in the RAM are not erased or cancelled although the ignition key 18 is turned off to stop the engine operation. Namely, this RAM 107 can be regarded as a nonvolatile memory. Data indicative of third correction factors K3 (engine condition correcting amounts), which will be described later, will be stored in the RAM 107. The RAM 107 is coupled via the common bus 150 to the CPU 100 so that various data will be written in and read out from the RAM 107 as will be described hereinlater.

A read-only memory (ROM) 108 is connected via the common bus 150 to the CPU 100 for supplying the same with an operational program and various constants. As is well known, the data or information contained in the ROM 108 has been prestored therein in nonerasable form when manufacturing so that the data can be maintained as they are irrespectively of the manipulation of the ignition key 18.

A counter 109 including a down counter and registers is provided for producing pulse signals, the pulse width of which corresponds to the quantity of fuel to be supplied to the engine 1. The counter 109 is coupled via the common bus 150 to the CPU 100 for receiving digital signals indicative of the quantity of fuel which should be fed to the engine 1. Namely, the counter 109 converts its digital input into a pulse train signal, the pulse width of which is varied by the digital input, so that fuel injection valves 5 are successively energized for an interval defined by the pulse with to inject fuel into the intake manifold 3. The pulse train signal produced in the counter 109 is then applied to a driving stage 110 for producing a driving current with which the fuel injection valves 5 are energized successively.

A timer circuit 111 is connected via the common bus 150 to the CPU 100 for supplying the same with information of laps of time measured.

The rotation number counter 101 measures the number of rotations of the engine crankshaft once per a revolution of the engine crankshaft by counting the number of pulses from the engine rotational speed sensor 15. The aforementioned interrupt instruction is produced at the end of each measurement of the engine speed. In response to the interrupt instruction the interrupt control unit 102 produces an interrupt signal which will be fed to the CPU 100. Accordingly, the running program stops to execute the interrupt routine.

Figure 3:
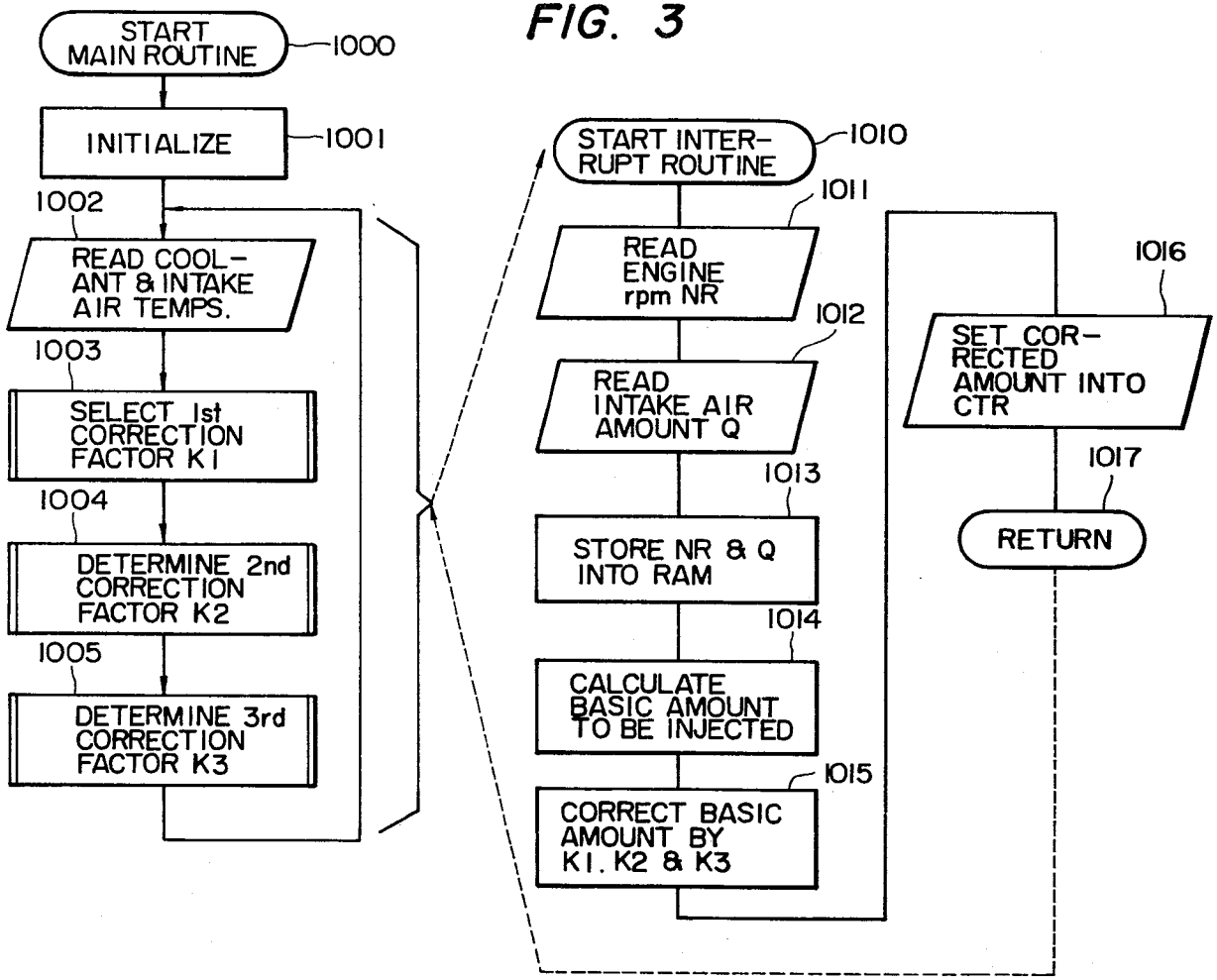
FIG. 3 is a flowchart showing the operational steps of the central processing unit shown in FIG. 2.

FIG. 3 is a flowchart showing brief operational steps of the CPU 100, and the function of the CPU 100 as well as the operation of the system of FIG. 2 will be described with reference to this flowchart. The engine 1 starts running when the ignition key 18 is turned on. The control unit 20 is thus energized to start the operational sequence from its starting step 1000. Namely, the main routine of the program will be executed. In a following step 1101, initialization is performed, then in a following step 1102, digital data of the coolant temperature and the intake air temperature applied from the analog input port 104 is stored. Then in a following step 1003, a first correction factor K1 is obtained on the basis of the above-mentioned data, and this first correction factor K1 will be stored in RAM 107.

The above-mentioned first correction factor K1 may be obtained, for instance, by selecting one value, in accordance with the coolant and intake air temperatures, from a plurality of values prestored in the ROM 108 in the form of a map. If desired, however, the first correction factor K1 may be obtained by solving a given formula with the above-mentioned data substituted. In a following step 1004, the output signal of the air/fuel ratio sensor 14 applied through the digital input port 103 is read, and a second correction factor K2, which will be described hereinlater, is either increased or decreased as a function of time measured by the timer 111. The second correction factor K2 indicates a result of integration and is stored in the RAM 107.

Figure 4:
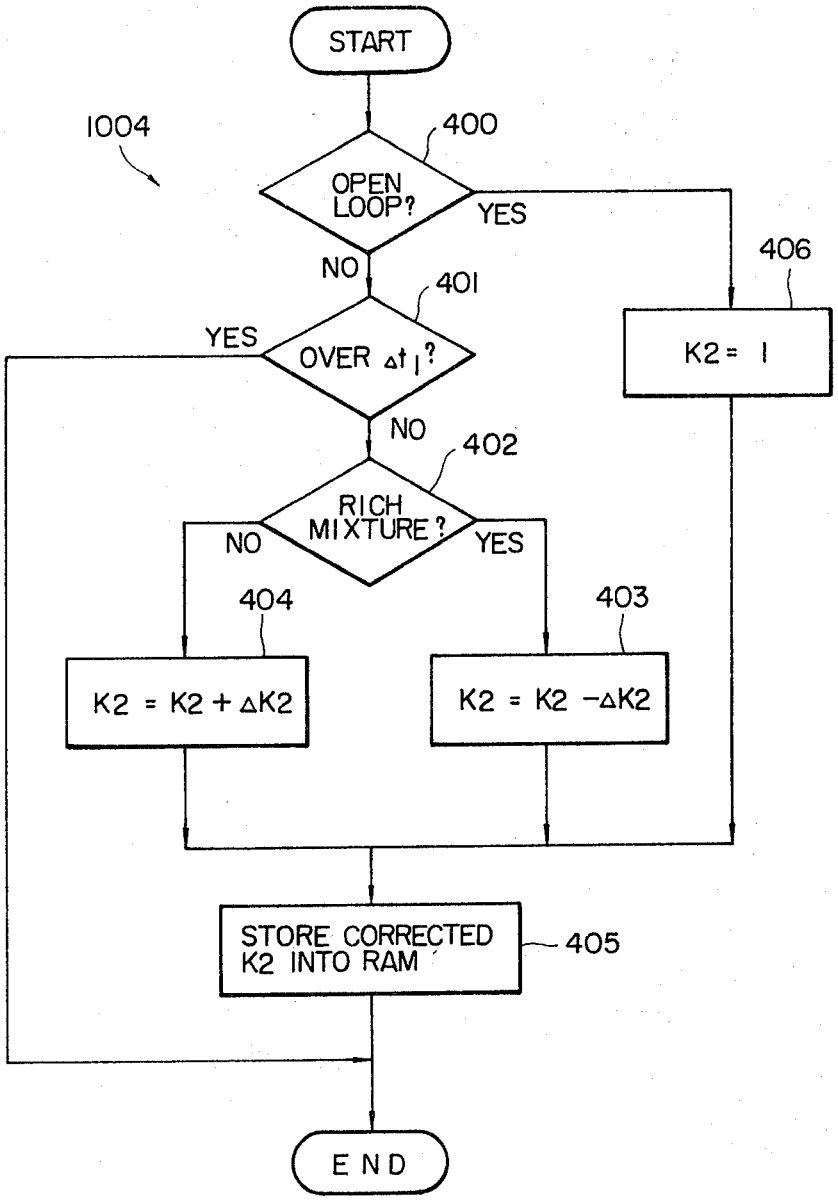
FIG. 4 is a detailed flowchart of the step for processing a second correction factor (integration correcting amount), which step is shown in FIG. 3.

FIG. 4 is a flowchart showing detailed steps included in the step 1004 of FIG. 3, which steps are used to either increase or decrease, i.e. to integrate, the second correction factor K2 (integration correcting amount). In a step 400, it is detected whether the feedback control system is in an open loop condition or in a closed loop condition. In order to detect such a state of the feedback control system, it is detected whether the air/fuel ratio sensor 14 is active or not. This step 400, however, may be replaced with a step of detecting whether the coolant temperature or the like is above a given level to be able to perform a feedback control. When a feedback control cannot be performed, i.e. when the feedback control system is in an open loop condition, a following step 406 takes place to set as K2=1, then entering into a following step 405.

On the other hand, when a feedback control can be performed, a step 401 takes place to detect whether the lapse of time measured has exceeded unit time Δt1. If the answer of the step 401 is NO, the operation of the step 1004 terminates. If the answer of this step is YES, i.e. when the measured lapse of time has exceeded the unit time Δt1, a following step 402 takes place to see whether the output signal of the air/fuel ratio sensor 14 indicates that the air/fuel mixture is rich or not. Assuming that a high level output signal of the air/fuel ratio sensor 14 indicates a rich mixture, when such a high level output signal is detected, the program enters into a step 403 in which the value of K2, which has been obtained in the prior cycle, is reduced by ΔK2. On the contrary, when the air/fuel mixture is detected to be lean, namely when the output signal of the air/fuel ratio sensor 14 is low, a step 404 takes place to increase the value of K2 by ΔK2. After the value of K2 is either increased or decreased as mentioned in the above, the aforementioned step 405 takes place to store the renewed value of K2 into the RAM 107.

Figure 5:
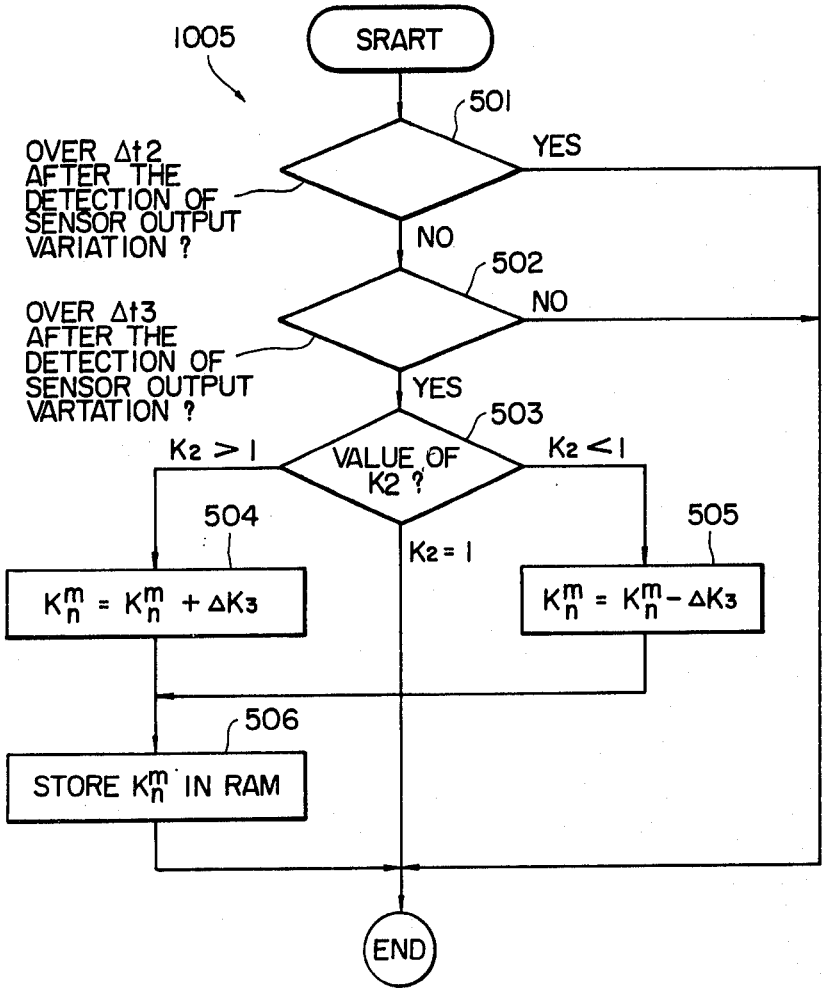
FIG. 5 is a detailed flowchart of the step for processing a third correction factor, which step is shown in FIG. 3.

Turning back to FIG. 3, a step 1005 follows the step 1004 which has been described in detail with reference to FIG. 4. In the step 1005, a third correction factor K3 (engine condition correcting amount) is calculated by varying the same, and the result of the calculation will be stored in the RAM 107. A detailed flowchart of the step 1005 is shown in FIG. 5, and the operation of K3 will be described with reference to FIG. 5.

Figures 6, 7:
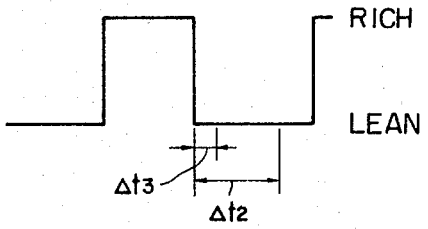
FIG. 6 is an explanatory diagram useful for understanding the operation of the central processing unit of FIG. 2.
FIG. 7 is a view of a map of the third correction factor (engine condition correcting amount).

In a step 501, it is detected whether the lapse of time, which is measured from the instant of detection of the variation of the air/fuel ratio sensor output from one state indicative of a rich mixture to the other state indicative of a lean mixture or vice versa, has exceeded a second unit time Δt2 or not. If the measured period has exceeded the unit time Δt2, the step of 1005 ends. On the other hand, if the period has not exceeded the unit time t2, a following step 502 takes place. In this step 502, it is detected whether the lapse of time, which is measured in the same manner as the above, has exceeded a third unit time Δt3 or not. The third unit time Δt3 is shorter than the second unit time Δt2 as shown in an explanatory diagram of FIG. 6. The measurement of the lapse of time is effected as follows. Each time the value of the output signal of the air/fuel ratio sensor 14 is read in the step 1004 of FIG. 3 the read value is compared with a former value which has been stored. If there is a difference between these two values, a datum of an address of the RAM 107 is reset to zero, and the value of the datum is increased one by one at a given interval. The increasing datum value is detected to measure the lapse of time. As another method, the datum value may be increased by one each time the engine crankshaft turns fully once. In this case an accumulative revolution counter responsive to the rotation of the engine crankshaft may be used. In the above, although it has been described that the lapse of time is measured from the instant of detection of the variation of the air/fuel ratio sensor output, the lapse of time may be measured from the instant of variation in the second correction factor K2.

If the lapse of time has not exceeded Δt3 in the step 502, the process in the step 1005 terminates. On the other hand, the lapse of time has exceeded Δt3, a step 503 takes place. In this step 503, the value of the second correction factor K2 is detected, and if K2=1, no further step will take place to end the step 1005.

The third correction factor is related to the operational condition of the engine 1. In detail, a number of third correction factors K3 constitute a map in the RAM 107 in such a manner that each of the third correction factors K3 corresponds to the intake air quantity Q and the rotational speed of the engine 1 as shown in a table of FIG. 7. A third correction factor K3 corresponding to the "m"th value of the intake air quantity Q and to an "n"th value of the engine rpm N is expressed in terms of $K_n^m$. In the embodiment of the present invention, a plurality of engine rpm values are used so that the values are spaced by 200 rpm, while the varying intake air quantity Q from the minimum quantity on idling to the maximum quantity on full load is divided into thirty-two values.

In the step 503, if K2>1, a step 504 takes place, and on the other hand, if K2<1, a step 505 takes place. In the steps 504 and 505, the value of the third correction factor $K_n^m$ read out from a given address of the RAM 107 is added or subtracted by ΔK3. After the addition or subtraction in the step 504 or 505, a step 506 takes place in which a new value of the third correction factor $K_n^m$ obtained as the result of addition or subtraction is stored in the RAM 107. Namely, the third correction factor K3 has been renewed in the step 504 or 505, and then the step 1005 ends to return to the step 1002 of the main routine of FIG. 3.

The above-mentioned period of time Δt3 is provided so that renewal of the third correction factor K3 is not effected within this period because the air/fuel ratio may not be stable within this short period t3 following immediately after the point of variation of the air/fuel ratio sensor output level. Another period of time Δt2 is provided so that renewal of the third correction factor K3 is not effected when a relatively long period of time has lapsed from the point of detection of the variatonn of the air/fuel ratio sensor output level because the sensed level of the air/fuel ratio sensor may be unreliable after the lapse of such a long period of time.

Turning back to FIG. 3, it will be described how the air/fuel ratio of the mixture supplied to the engine 1 is controlled in accordance with the present invention. The operational steps 1002 to 1005 of the main routine are repeatedly executed normally. However, when the aforementioned interrupt signal is applied to the CPU 100 from the interrupt control circuit 102, an interrupt routine also illustrated in FIG. 3 takes place. Namely, the execution of the steps of the main routine is stopped to enter into the interrupt routine even though execution of one cycle of the main routine has not yet been completed.

After the operational flow enters into the START step 1010 of the interrupt routine, a first step 1011 follows in which data indicative of the engine rpm N from the rotational number counter 101 is read. In a following step 1012, data indicative of the intake air quantity Q from the analog input port 104 is read. These data N and Q are respectively stored in the RAM 107 to calculate a basic quantity of fuel to be injected into each cylinder of the engine 1, through the intake manifold 3. The quantity of fuel injected into each cylinder is proportional to a period for which each of the electromagnetic injection valves 5 is made open. The basic quantity of fuel, is expressed in terms of "t", and this value of "t" is given by the following formula:

$$t = F \times N/Q$$

wherein F is a constant.

After the basic value of the opening interval "t" has been obtained in a step 1014, this basic opening interval "t" will be corrected by the above-mentioned three correction factors K1, K2 and K3 in a following step 1015. Namely, these correction factors k1, K2 and K3, which have been obtained in the operations of the main routine, are read out from the ROM 108 and RAM 107, and then a desired opening or injecting interval T will be calculated by the formula given below:

$$T = t \times K1 \times K2 \times K3$$

The opening interval T, which has been obtained as the result of the above-mentioned calculation, is then set in the counter 109 so as to effect pulse width modulation in connection with the pulse applied to the drive circuit 110. Each of the injection valves 5 will be energized for the opening inteval T in receipt of each pulse from the driving circuit 110 to inject a given quantity of fuel defined by the interval T. The interrupt routine terminates at an END step 1017 after the completion of the step 1016 and thus the operational flow returns to the original step in the main routine where the operation has been interrupted.

Although the above-described embodiment is an example of air/fuel ratio control by controlling the actuating interval of fuel injection valves of an electronic fuel injection system, the air/fuel ratio may be controlled by other ways. For instance, in an internal combustion engine equipped with a carburettor, the quantity of fuel supplied to the carburettor and/or the quantity of air bypassing the carburettor may be controlled. Furthermore, the quantity of secondary air supplied to the exhaust system of an engine may be controlled so that the concentration of a gas component included in the gasses applied to the following catalytic converter is desirably controlled as if the air/fuel ratio of the mixture supplied to the engine were controlled to a desired value.

From the foregoing description, it will be understood that a suitable correcting amount can be used instantaneously inasmuch as many third correction factors K3, i.e. $K_n^m$ corresponding to various values of the intake air quantity and to various values of the engine rpm are provided. Thus, the control of air/fuel ratio can be effected with quick response with respect to any operating conditions including transient conditions of the engine. Furthermore, in the case that the second correction factor (integration correcting amount) K2 has been undesirably shifted or deviated on abnormal conditions of the air/fuel ratio sensor etc, only a small amount of the correction of the third correction factor K3 is required. In the case that the output signal level of the air/fuel ratio sensor does not change for a relatively long period of time, the second correction factor K2 is set to 1, while the third correction factor K3 is not changed. Therefore, the air/fuel ratio to be controlled is prevented from drastically deviating from a desired value or point by using such a value of K2 and a prestored value of K3. The above-described embodiment is just an example of the present invention, and therefore, it will be apparent for those skilled in the art that many modifications and variations may be made without departing from the spirit of the present invention.

What is claimed is:

1. A method for controlling air/fuel ratio in an internal combustion engine equipped with a feedback control system which controls the air/fuel ratio in accordance with an output signal of a gas sensor detecting the concentration of a gas component in the exhaust gasses of said engine, said method comprising the steps of:

(a) integrating said output signal from said gas sensor for obtaining an integration correcting amount, which will be used for modifying a variable defining air/fuel ratio;

(b) calculating an engine condition correcting amount, which will be also used for modifying said variable, on the basis of engine condition parameters;

(c) storing said engine condition correcting amount in a memory;

(d) renewing said engine condition correcting amount stored in said memory by using said integration correcting amount within a predetermined period of time from the instant of variation of said output signal of said gas sensor from its one state indicative of a rich mixture to the other state indicative of a lean mixture or vice versa, or after the instant of increase or decrease in said integration correcting amount;

(e) calculating said variable by using engine condition parameters; and (f) controlling the air/fuel ratio by correcting said variable by both said integration correcting amount and said engine condition correcting amount.

2. A method for controlling air/fuel ratio in an internal combustion engine equipped with a feedback control system which controls the air/fuel ratio in accordance with an output signal of a gas sensor detecting the concentration of a gas component in the exhaust gasses of said engine, said method comprising the steps of:

(a) integrating said output signal from said gas sensor for obtaining an integration correcting amount, which will be used for modifying a variable defining air/fuel ratio;

(b) calculating an engine condition correcting amount, which will be also used for modifying said variable, on the basis of engine condition parameters;

(c) storing said engine condition correcting amount in a memory;

(d) renewing said engine condition correcting amount stored in said memory by using said integration correcting amount within a first predetermined period of time from the instant of lapse of a second predetermined period of time from the instant of variation of said output signal of said gas sensor from its one state indicative of a rich mixture to the other state indicative of a lean mixture or vice versa, or after the instant of increase or decrease in said integration correcting amount;

(e) calculating said variable by using engine condition parameters; and (f) controlling the air/fuel ratio by correcting said variable by both said integration correcting amount and said engine condition correcting amount.

3. A method for controlling air/fuel ratio as claimed in claim 1 or 2, wherein said step of integrating comprises the steps of:

(a) detecting whether the output signal of said gas sensor indicates a rich mixture or a lean mixture;

(b) subtracting a given value from the value of said integration correcting amount obtained in the prior cycle if said gas sensor output indicates a rich mixture; and (c) adding said given value to the value of said integration correcting amount obtained in the prior cycle if said gas sensor output indicates a lean mixture.

4. A method for controlling air/fuel ratio as claimed in claim 1 or 2, wherein said step of integrating comprises the steps of:

(a) detecting whether the feedback control system is in an open loop condition or not;

(b) settng said integration correcting amount to 1 if said feedback control system is in an open loop condition;

(c) detecting whether time has lapsed over a first predetermined period of time if said feedback control system is in a closed loop condition;

(d) detecting whether the output signal of said gas sensor indicates a rich mixture or a lean mixture if time has lapsed over said first predetermined period of time;

(e) subtracting a given value from the value of said integration correcting amount obtained in the prior cycle if said gas sensor output indicates a rich mixture;

(f) adding said given value to the value of said integration correcting amount obtained in the prior cycle if said gas sensor output indicates a lean mixture; and (g) storing the value of said integration correcting amount into a storage device.

5. A method for controlling air/fuel ratio as claimed in claim 2, wherein said steps of calculating, storing and renewing comprise the steps of:

(a) selecting one engine condition correcting amount from a plurality of engine condition correcting amounts by using said engine condition parameters;

(b) detecting whether time has lapsed over a second predetermined period of time;

(c) detecting whether time has lapsed over a third predetermined period of time, which is shorter than said second predetermined period of time, if time has not lapsed over said second predetermined period of time;

(d) unchanging said engine condition correcting amount if time has lapsed over said second predetermined period of time or has not lapsed over said third predetermined period of time;

(e) detecting the value of said integration correcting amount;

(f) adding a given value to the value of said engine condition correcting amount if the value of said integration correcting amount is greater than 1;

(g) subtracting said given value from the value of said engine condition correcting amount if the value of said integration correcting amount is smaller than 1;

(h) unchanging said engine condition correcting amount if the value of said integration correcting amount equals 1; and (i) storing the value of said engine condition correcting amount which has been renewed.

6. A method for controlling air/fuel ratio in an internal combustion engine equipped with a feedback control system which controls the air/fuel ratio in accordance with an output signal of a gas sensor detecting the concentration of a gas component in the exhaust gasses of said engine, said method comprising the steps of:

(a) integrating said output signal from said gas sensor for obtaining an integration correcting amount, which will be used for modifying a variable defining air/fuel ratio;

(b) calculating an engine condition correcting amount, which will be also used for modifying said variable, on the basis of engine condition parameters;

(c) storing said engine condition correcting amount in a memory;

(d) renewing said engine condition correcting amount stored in said memory by using said integration correcting amount within an interval corresponding to a given number of rotations of the engine from the instant of variation of said output signal of said gas sensor from its one state indicative of a rich mixture to the other state indicative of a lean mixture or vice versa, or after the instant of increase or decrease in said integration correcting amount;

(e) calculating said variable by using engine condition parameters; and (f) controlling the air/fuel ratio by correcting said variable by both said integration correcting amount and said engine condition correcting amount.

7. A method for controlling air/fuel ratio in an internal combustion engine equipped with a feedback control system which controls the air/fuel ratio in accordance with an output signal of a gas sensor detecting the concentration of a gas component in the exhaust gasses of said engine, said method comprising the steps of:

(a) integrating said output signal from said gas sensor for obtaining an integration correcting amount, which will be used for modifying a variable defining air/fuel ratio;

(b) calculating an engine condition correcting amount, which will be also used for modifying said variable, on the basis of engine condition parameters;

(c) storing said engine condition correcting amount in a memory;

(d) renewing said engine condition correcting amount stored in said memory by using said integration correcting amount within an interval corresponding to a given number of rotations of the engine from the instant of lapse of a second predetermined period of time from the instant of variation of said output signal of said gas sensor from its one state indicative of a rich mixture to the other state indicative of a lean mixture or vice versa, or after the instant of increase or decrease in said integration correcting amount;

(e) calculating said variable by using engine condition parameters; and (f) controlling the air/fuel ratio by correcting said variable by both said integration correcting amount and said engine condition correcting amount.

8. A method for controlling air/fuel ratio as claimed in claim 7, wherein said steps of calculating, storing and renewing comprise the steps of:

(a) selecting one engine condition correcting amount from a plurality of engine condition correcting amounts by using said engine condition parameters;

(b) detecting whether time has lapsed over a second predetermined period of time;

(c) detecting whether time has lapsed over a third predetermined period of time, which is shorter than said second predetermined period of time, if tim has not lapsed over said second predetermined period of time;

(d) unchanging said engine condition correcting amount if time has lapsed over said second predetermined period of time or has not lapsed over said third predetermined period of time;

(e) detecting the value of said integration correcting amount;

(f) adding a given value to the value of said engine condition correcting amount if the value of said integration correcting amount is greater than 1;

(g) subtracting said given value from the value of said engine condition correcting amount if the value of said integration correcting amount is smaller than 1;

(h) unchanging said engine condition correcting amount if the value of said integration correcting amount equals 1; and (i) storing the value of said engine condition correcting amount which has been renewed.

* * * * *